US010466014B1

(12) United States Patent
Schoettle

(10) Patent No.: US 10,466,014 B1
(45) Date of Patent: Nov. 5, 2019

(54) PALM PROTECTOR

(71) Applicant: Steven J Schoettle, St. Simons Island, GA (US)

(72) Inventor: Steven J Schoettle, St. Simons Island, GA (US)

( * ) Notice: Subject to any disclaimer, the term of this patent is extended or adjusted under 35 U.S.C. 154(b) by 666 days.

(21) Appl. No.: 14/920,958

(22) Filed: Oct. 23, 2015

(51) Int. Cl.
*F41H 1/02* (2006.01)
*A41D 13/08* (2006.01)
*A41D 31/24* (2019.01)

(52) U.S. Cl.
CPC ..... *F41H 1/02* (2013.01); *A41D 13/082* (2013.01); *A41D 31/24* (2019.02)

(58) Field of Classification Search
CPC ..... A41D 13/082; A41D 31/0055; F41H 1/02
USPC ..... 2/16, 20, 21; 294/25
See application file for complete search history.

(56) References Cited

U.S. PATENT DOCUMENTS 4,967,419 A * 11/1990 Elliott ..... A41D 13/08 2/16
5,729,831 A * 3/1998 Kuhlmann ..... A41D 19/01511 2/159
5,858,054 A * 1/1999 Rosen ..... A41D 13/084 2/2.5
5,862,521 A * 1/1999 van Marwijk ... A41D 19/01511 2/16
6,076,190 A * 6/2000 Besson ..... A41D 19/01511 2/16
2001/0052141 A1* 12/2001 Andersen ..... A41D 19/01511 2/2.5

* cited by examiner

*Primary Examiner* — Katherine M Moran
(74) *Attorney, Agent, or Firm* — Jonathan Rigdon Smith, J.D., PC; Jonathan R. Smith

(57) ABSTRACT

A chain mail pad has at least one substantially straight side into which two loops are formed to encircle two of the fingers, preferably the thumb and forefinger. When the two loops are placed over these fingers and the pad draped over the palm, the palm and proximal portions of the inner surfaces of the fingers are protected from puncture and cuts that would otherwise be caused by slippage of a shellfish shucking knife.

15 Claims, 3 Drawing Sheets

PALM PROTECTOR

CROSS-REFERENCES TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A BIOLOGICAL SEQUENCE LISTING

Not applicable.

BACKGROUND OF INVENTION

Field of the Invention

This invention is in the field of personal protective wear, more specifically in the field of armor, still more specifically in the field of armor for the human hand, still more specifically in armor for protection of the palm, and still more specifically in hand protectors that leave portions of the fingers unencumbered. The invention is also in the field of food preparation, more specifically in protection of the hand from cutlery wounds, and still more specifically in the prevention of cuts from shellfish shucking implements.

Description of the Related Art

Gloves to cover and protect the entire hand are old art. A leather glove is commonly used for hand protection in shucking shellfish. The drawback to such gloves is that they themselves can be penetrated by a knife, they inhibit the dexterity of the fingers, and they are not easy to clean thoroughly. A leather oyster-shucking glove can be made more "user friendly" by cutting the glove's thumb and forefinger off so that the user can eat food with the same hand, but the edges and surfaces of the glove are absorbent and become sticky. The result is that even if such a glove is pre-sanitized, it absorbs juices and accumulates dirt during use.

Specialized hand protectors are a more recent development in the U.S. patent record. U.S. Pat. No. 2,205,957 to Kinkis describes a flexible pad covering the palm and fingers, supported by a flexible strap about the wrist formed from a slit in the pad. U.S. Pat. No. 6,178,554 to Pake et al. describes a flexible pad covering the palm and fingers, having a hole at one end through which the hand can be inserted. The chief drawback of these pads is that they are hard to keep in place over the palm, especially while the same hand is used to palm a shellfish for opening. They also can be penetrated by a knife unless they are so thick and tough as to be useless for holding a shellfish during shucking.

There is a long-felt and unsatisfied need for an impenetrable palm protector for shucking shellfish that leaves the thumb and the tips of the other fingers free to manipulate the food, as well as not absorbing juice and dirt during use.

BRIEF DESCRIPTION OF THE INVENTION

Objects of the Invention

The chief object of the invention is to provide an impenetrable palm protector for shucking shellfish that leaves the thumb and the tips of the other fingers free to manipulate the food. A further object of the invention is to allow the user to eat the food from the same hand with less risk of contamination by residue left on the protector. Yet another object of the invention is to allow the palm protector to be rinsed easily either on or off the hand.

SUMMARY OF THE INVENTION

The invention is a chain mail pad with at least one substantially straight side edge into which two loops are formed to encircle two of the fingers, preferably the thumb and forefinger. When the two loops are placed over these fingers and the pad draped over the palm, the palm and proximal portions of the inner surfaces of the fingers are protected from puncture and cuts that would otherwise be caused by slippage of a shellfish shucking knife.

DETAILED DESCRIPTION OF THE INVENTION

Figure 1:
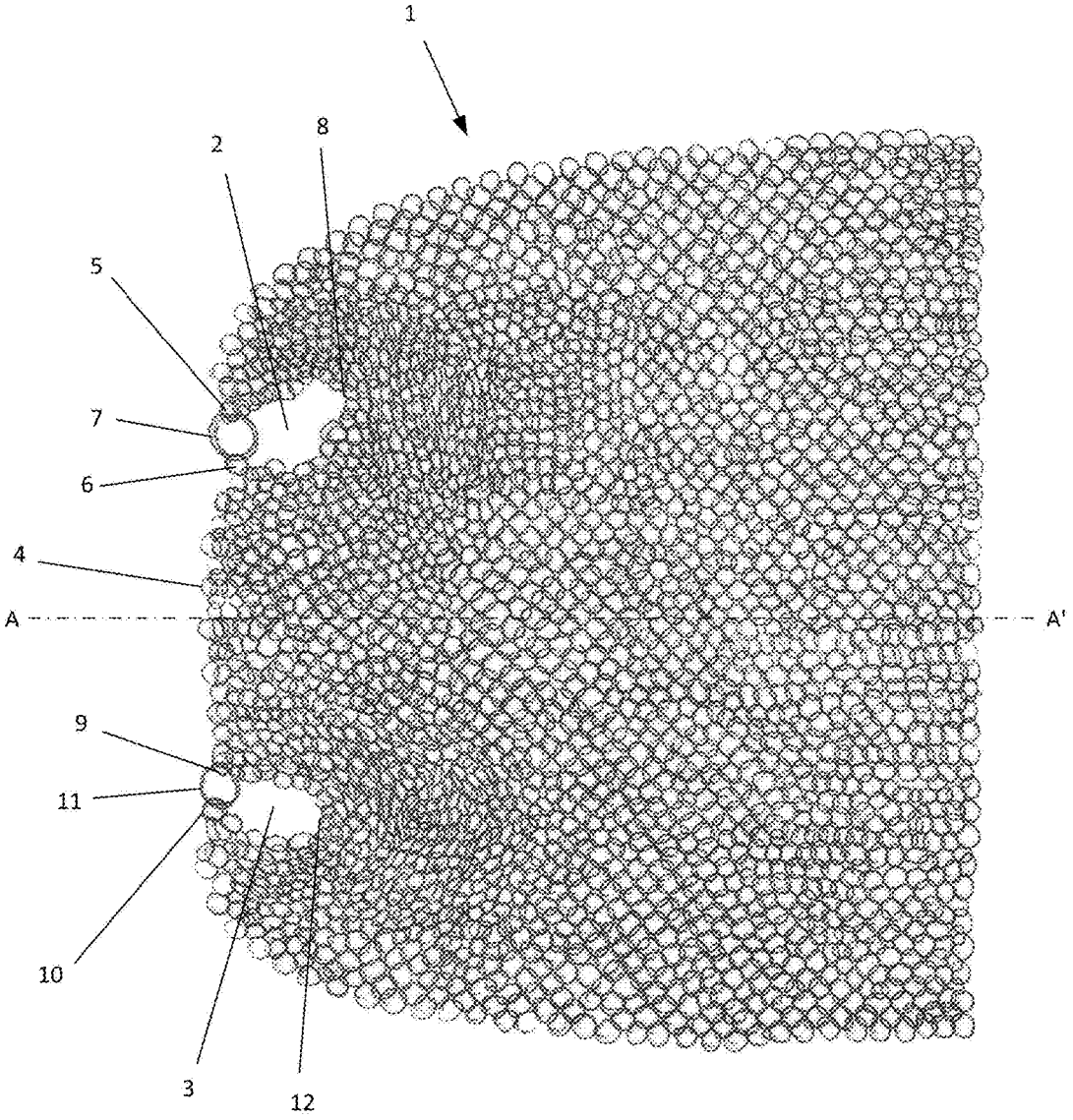
FIG. 1 shows the invention as it appears when not in use.

Referring now to the drawings, in which like reference characters refer to like elements among the drawings, FIG. 1 shows the invention as it appears when not in use. It consists of a flat chain mail pad 1 having a first edge loop 2 and a second edge loop 3 formed along the left edge 4 of the pad 1. First edge loop 2 is created by joining a first chain link 5 to a second chain link 6 with a first ring 7 so as to bunch a portion of left edge 4 to form the periphery 8 of the first edge loop 2. The periphery 8 is sized to encircle the base of a large "one-size-fits-all" finger. Second edge loop 3 is formed in a similar fashion along left edge 4, in which a third chain link 9 is joined to a fourth chain link 10 by a second ring 11 to form the periphery 12 of the second edge loop 3. Note that the invention is substantially bilaterally symmetrical about axis A-A'. In embodiments, the rings 7 and 11 may consist of one or groups of two or more links similar in size to the chain mail links. In additional embodiments, the rings 7 and 11 may be opened, repositioned, and re-closed to allow adjustment of the size of the peripheries 8 and/or 12, respectively, and/or the distance between the second chain link 6 and the third chain link 9.

Figure 2:
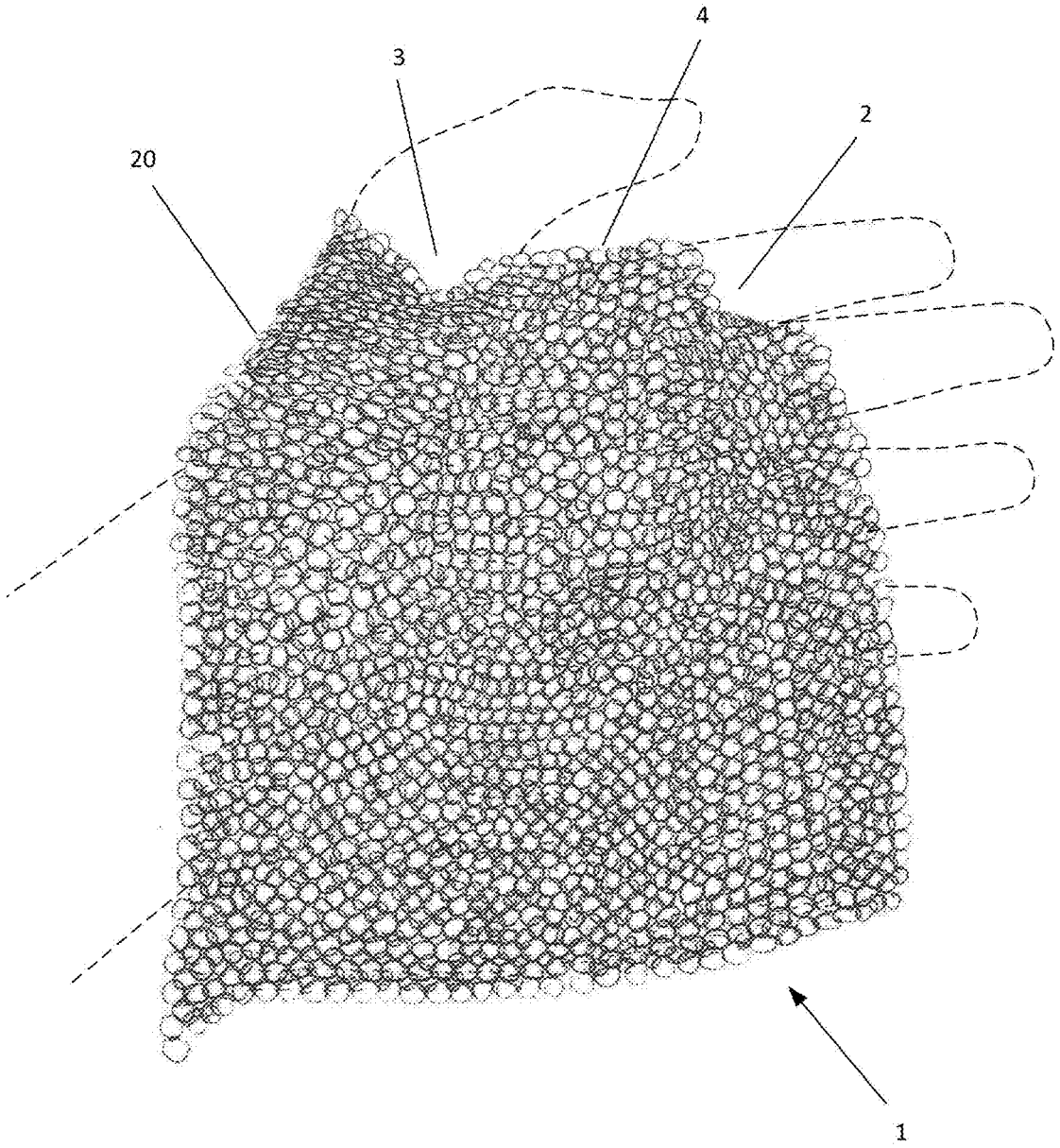
FIG. 2 shows the invention in use as worn on a person's left hand.

FIG. 2 shows the invention in use as worn on a person's left hand, although because the device is symmetrical it can be worn with equal utility on the right hand. The forefinger of the left hand (shown here in dashed lines as environmental structure) has been inserted through first edge loop 2, and the thumb has been inserted through second edge loop 3, allowing the pad 1 to drape over the palm of the hand (not visible). Because the pad 1 is substantially flat (see FIG. 3)

it covers only the palm without wrapping around the hand. Note that because the edge loops 2 and 3 are largely formed from the pad 1 itself, the pad 1 covers the heel area 20 of the thumb and the web of the palm of a hand between the fingers along edge 4 (left edge 4 in FIG. 1). Note also that if the edge loops are of equal size, the invention can be worn with either side facing the palm without regard to which finger passes through which edge loop.

Chain mail is a very tough metal structure consisting of many tiny chain links joined together to form a fabric. It was used at least as early as medieval times to protect against sharp-edged weapons. It cannot be penetrated by a blade having a point or edge broader than the inner diameter of the links, even under the great force sometimes necessary to open shellfish. Metal surfaces are not absorbent and the weave is open enough to be cleaned easily, even during use. The scope of this invention also includes other open fabrics composed of material sufficiently tough to resist penetration by forces and blades used to shuck shellfish, and sufficiently smooth and non-absorbent to enable easy sanitization.

Figure 3:
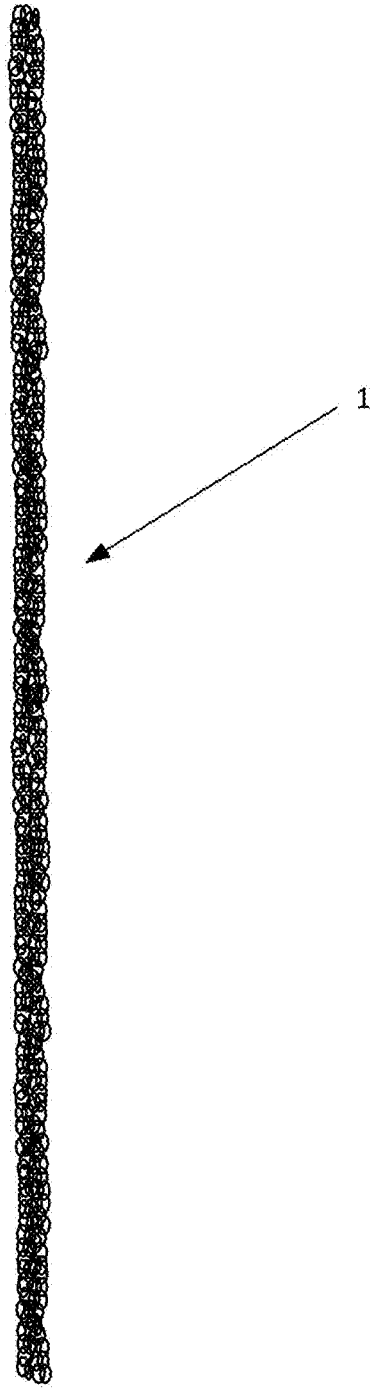
FIG. 3 is a side, top, left, right, and bottom view of the invention.

FIG. 3 is a view showing pad 1 as it would appear from either side, top, and bottom, namely as a substantially flat array of interlocking links. Being flexible, the pad 1 will, within the scope of the invention, flex out of a purely flat (linear in this view) appearance. The first and second rings, 7 and 11 respectively in FIG. 1, typically will not be discernible individually in this view.

The palm protector described above may be described alternatively as comprising: a flat pad 1 comprised of a plurality of interconnected links surrounded by an edge of links; the edge of links further comprising a first chain link 5, a second chain link 6, a third edge link location 9, and a fourth edge link location 10; the first and second edge link locations separated by a first distance (periphery 8) along the edge; the second and third edge link locations separated by a second distance along the edge; the third and fourth edge link locations separated by a third distance (periphery 12) along the edge; the first and second edge link locations being joined by a first ring 7 to form a first edge loop 2; and the third and fourth edge link locations being joined by a second ring 11 to form a second edge loop 3.

The palm protector may further be described as having a first edge loop 2 so dimensioned as to fit about a thumb; and that the second distance is so dimensioned as to fit the web of a hand between a thumb and forefinger; and that the second edge loop 3 is so dimensioned as to fit about a forefinger. The first and second edge loops may be of equal size as mentioned above.

The material from which the links are made may be smooth and tough and non-absorbent, such as in, but not limited to, chain mail.

The rings 7 and 11 of the palm protector may be detachable from the edge links.

A further alternative description of the palm protector is a pad 1 of chain mail having an edge of links; the edge of links having a first width, a first chain link 5 at one end of the edge and a second end link 10 at the other; the second chain link 6 separated from the first chain link 5 by a second width. The first chain link 5 is joined to the second chain link 6 by a first ring 7 forming a first edge loop 2; a second intermediary link 9 is separated from the second chain link 6 by a third width along the edge of links; the second intermediary link 9 is separated from the second end link 10 by a fourth width, and the second end link 10 is joined to the second intermediary link 9 by a second ring 11 forming a second edge loop 3. The first width is equal to the sum of the second, third and fourth widths; the second width being approximately the circumference of a thumb; the third width being approximately the length of the web between a thumb and a forefinger; the fourth width being approximately the circumference of a forefinger; and the pad 1 having a length from left to right along axis A-A' so dimensioned as to cover the palm of a hand.

In this alternative description, the first ring of the palm protector may be detachable from the first end link and the first intermediary link; and the second ring may be detachable from the second end link and the second intermediary link.

In yet another description of the palm protector, it may comprise a pad 1 so dimensioned to cover the palm of a hand, the palm protector having an edge and a thumb loop and a finger loop formed in the pad 1 proximate to the edge and separated by a distance approximating the length of the web between the thumb and the forefinger.

The pad 1 of this palm protector may be comprised of interlocked links of smooth, tough and non-absorbent material such as metal or chain mail. The distance separating the thumb and finger loops may be adjustable.

The invention claimed is:

1. A palm protector, consisting of:

a flat pad sized to cover the palm of a hand, consisting of a plurality of interconnected links surrounded by an edge of links;

the edge of links comprising a first edge link location, a second edge link location, a third edge link location, and a fourth edge link location;

the first and second edge link locations separated by a first distance along the edge;

the second and third edge link locations separated by a second distance along the edge;

the third and fourth edge link locations separated by a third distance along the edge;

the first and second edge link locations being joined by a first ring to form a first edge loop; and the third and fourth edge link locations being joined by a second ring to form a second edge loop.

2. The palm protector of claim 1, wherein:

said first edge loop is so dimensioned as to fit about a thumb of said hand;

said second distance is so dimensioned as to fit the web of said hand between the thumb and the forefinger; and said second edge loop is so dimensioned as to fit about a forefinger.

3. The palm protector of claim 1, wherein:

said first and second edge loops are of equal dimensions.

4. The palm protector of claim 1, wherein:

the material from which said links are made is said material from which said links are made is non-absorbent, smooth and tough.

5. The palm protector of claim 4, wherein:

said material is chain mail.

6. The palm protector of claim 1, in which:

said rings are detachable from said edge links.

7. The palm protector of claim 1, wherein:

said first and second rings are comprised of one or more of said links.

8. A palm protector, consisting of:

a pad of chain mail having at least one edge of links;

having a first width, a first end link at one end of the edge and a second end link at the other;

a first intermediary link separated from the first end link by a second width along the edge of links;

the first end link being joined to the first intermediary link by a first ring;

a second intermediary link separated from the first intermediary link by a third width along the edge of links;

the second intermediary link separated from the second end link by a fourth width along the edge of links; and the second end link being joined to the second intermediary link by a second ring;

the first width being equal to the sum of the second, third and fourth widths;

the second width adapted to receive a thumb;

the third width adapted to span the web of the palm of a hand between the thumb and the forefinger;

the fourth width being adapted to receive a forefinger; and the pad having a length perpendicular to a line connecting the rings, the length as being adapted to cover the palm of a hand.

9. The palm protector of claim 8, in which:

said first ring is detachable from said first end link and said first intermediary link; and said second ring is detachable from said second end link and said second intermediary link.

10. A palm protector, consisting of:

a pad being adapted in shape to cover the palm of a hand, and having an edge;

a thumb loop and a finger loop formed in the pad proximate to the edge and separated by a distance adapted to span the length of the web of the palm of a hand between the thumb and the forefinger.

11. The palm protector of claim 10, wherein:

said pad is comprised of interlocked links of smooth and tough material.

12. The palm protector of claim 11, wherein:

said material is non-absorbent.

13. The palm protector of claim 12, in which:

said material is metal.

14. The palm protector of claim 10, in which:

said pad is chain mail.

15. The palm protector of claim 10, in which:

said distance separating said loops is adjustable.

* * * * *